US008517200B1

(12) United States Patent
Davis

(10) Patent No.: US 8,517,200 B1
(45) Date of Patent: Aug. 27, 2013

(54) DECORATIVE RADIATOR CAP COVER RETENTION SYSTEM FOR AUTOMOTIVE USE

(75) Inventor: Ronny L. Davis, Litchfield Park, AZ (US)

(73) Assignee: Ron Davis Racing Products, Inc., Glendale, AZ (US)

( * ) Notice: Subject to any disclaimer, the term of this patent is extended or adjusted under 35 U.S.C. 154(b) by 757 days.

(21) Appl. No.: 12/538,022

(22) Filed: Aug. 7, 2009

Related U.S. Application Data

(60) Provisional application No. 61/087,529, filed on Aug. 8, 2008.

(51) Int. Cl.
*B65D 51/18* (2006.01)

(52) U.S. Cl.
USPC ..... 220/254.1; 220/254.7; 220/254.8; 220/256.1; 220/DIG. 32; 220/DIG. 33

(58) Field of Classification Search
USPC ..... 220/376, DIG. 32, DIG. 33, 212, 220/254.1, 254.2, 254.7, 256.1, 254.8
See application file for complete search history.

(56) References Cited

U.S. PATENT DOCUMENTS

| | | | | |
|---|---|---|---|---|
| 5,036,888 | A * | 8/1991 | Scharrer et al. | 138/89 |
| 6,178,930 | B1 * | 1/2001 | Triberti | 123/41.15 |
| 6,968,968 | B2 * | 11/2005 | Buckley et al. | 220/257.1 |
| 7,380,681 | B2 * | 6/2008 | Reutter | 220/203.27 |

* cited by examiner

*Primary Examiner* — Mickey Yu
*Assistant Examiner* — Brijesh V Patel
(74) *Attorney, Agent, or Firm* — Lewis and Roca LLP

(57) ABSTRACT

A decorative radiator cap cover retention system provides for removable attachment of a radiator cap cover to a radiator cap using a retaining ring inside the radiator cap cover to removably attach the cap cover to the radiator cap. The inside of the radiator cap cover may have indentions conforming to the shape of the radiator cap and a groove for the retaining ring. Preferably, the number and shape of the intentions is sufficient to match the shape of many radiator caps.

4 Claims, 2 Drawing Sheets

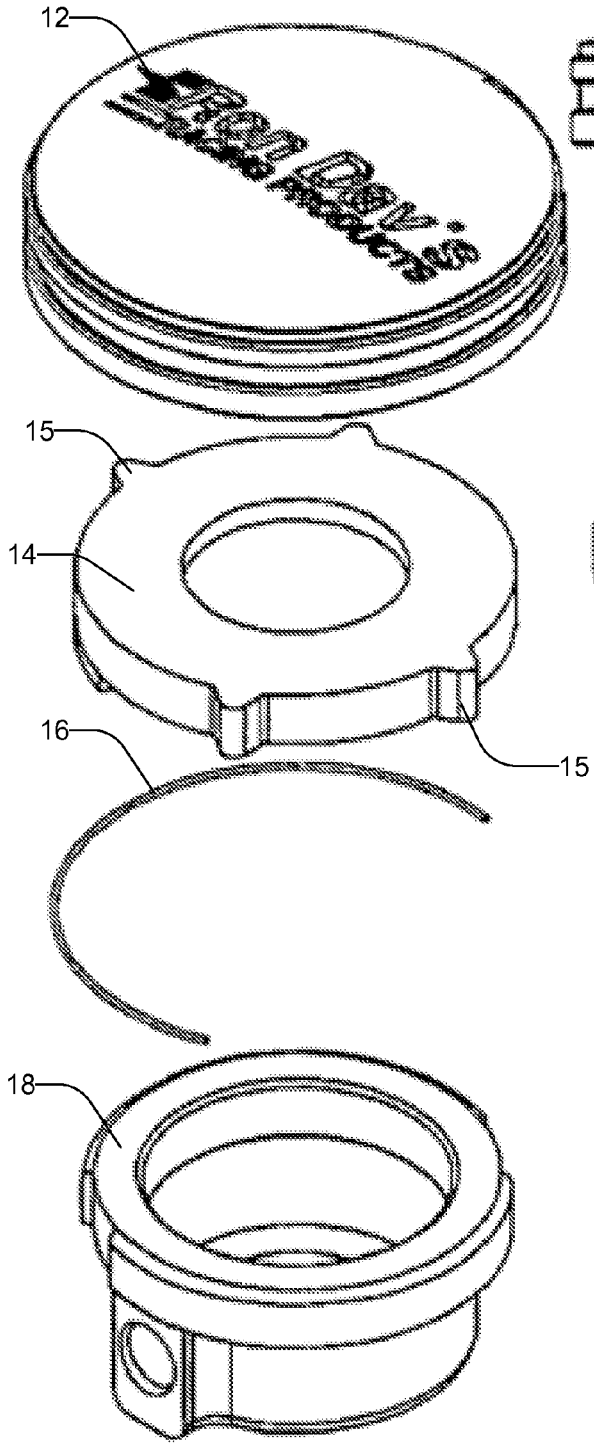
FIG. 1
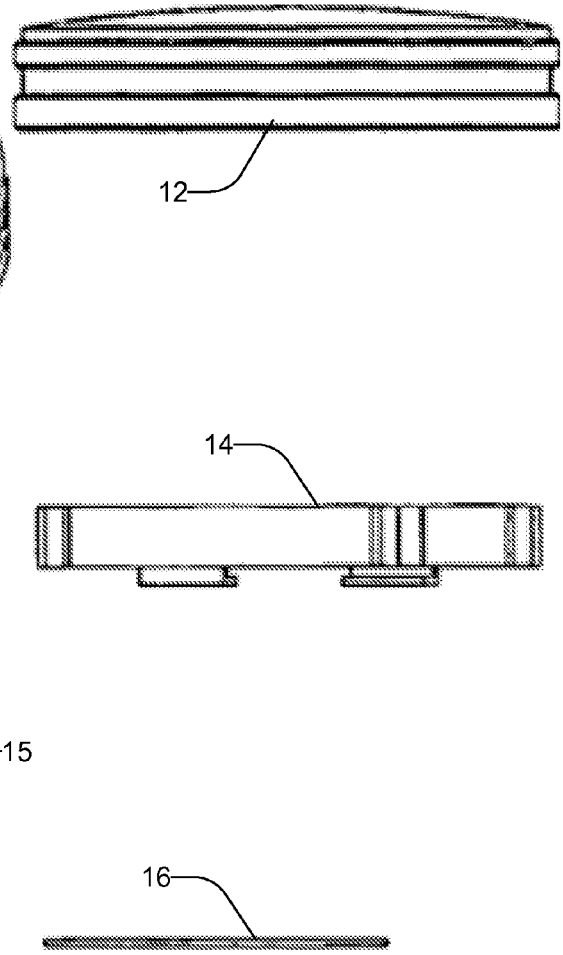
FIG. 2
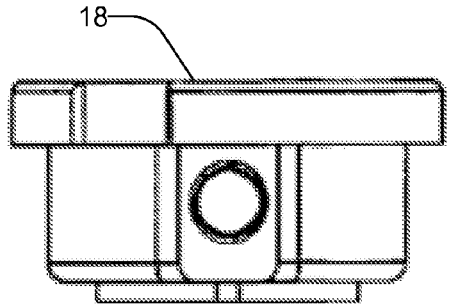

FIG. 4
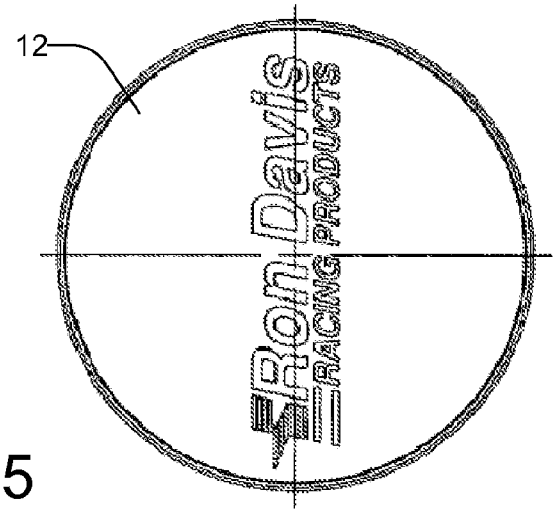
FIG. 5
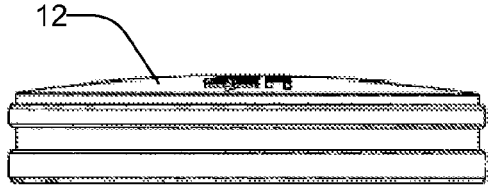
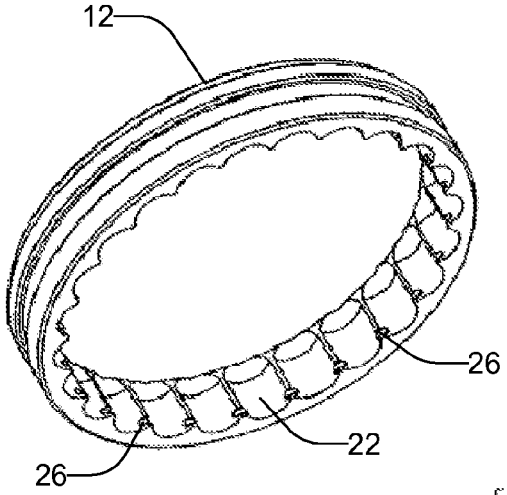
FIG. 3
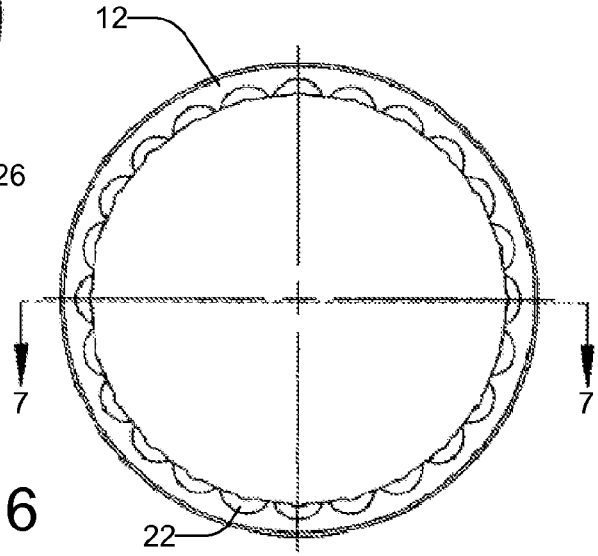
FIG. 6
FIG. 7
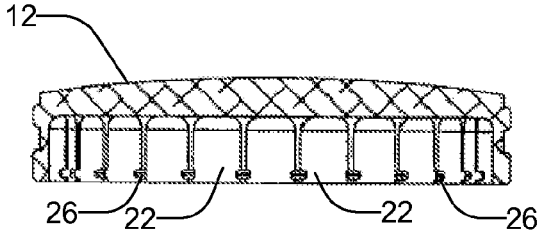

DECORATIVE RADIATOR CAP COVER RETENTION SYSTEM FOR AUTOMOTIVE USE

CROSS-REFERENCE TO RELATED APPLICATIONS

This application is claims priority to our U.S. Patent Provisional Application Ser. No. 61/087,529, filed Aug. 8, 2008, the entirety of which is incorporated by reference herein.

BACKGROUND OF THE INVENTION

1. Field of the Invention

The present invention relates to heat exchangers for an automotive vehicle and, more specifically, to a system for removably attaching a decorative radiator cap cover to a radiator cap.

2. The Prior Art

One might expect the term "radiator" to apply to devices which transfer heat primarily by thermal radiation, while a device which relied primarily on natural or forced convection would be called a "convector". In practice, the term "radiator" refers to any of a number of devices in which a liquid circulates through exposed pipes (often with fins or other means of increasing surface area), notwithstanding that such devices tend to transfer heat mainly by convection and might logically be called convectors. The term "convector" typically refers to a class of devices in which the source of heat is not directly exposed.

In automobiles with a liquid-cooled internal combustion engine, a radiator is typically connected to channels running through the engine and cylinder head, through which a liquid (coolant) is pumped. This liquid is typically a half-and-half mixture of water and ethylene glycol or propylene glycol (with a small amount of corrosion inhibitor) known as antifreeze. The radiator transfers the heat from the fluid inside to the air outside, thereby cooling the engine. Radiators are generally mounted in a position where they will receive airflow from the forward movement of the vehicle, such as behind the grill. Where engines are rear- or mid-mounted, it is typically still necessary to mount the radiator behind the front grill, so as to achieve sufficient airflow, even though this requires long coolant pipes. The coolant system in a typical well maintained vehicle is typically air and coolant tight, so that the coolant does not leak out, and it is typically maintained at a higher than atmospheric pressure when the radiator is operating to dissipate a maximum amount of engine heat.

In a typical radiator, a radiator cap provides two functions. First, it allows the addition of more coolant to the cooling system. Secondly, it works as a release valve, allowing excess coolant to escape when the pressure in the cooling system becomes excessive. Unfortunately, due to use, radiator caps can wear out over time, and need to be replaced. If they are not replaced, either excess pressure in the cooling system can cause leaks, or insufficient pressure is maintained, resulting in lesser cooling, and possibly engine damage.

Replacing radiator caps for many cars is fairly easy. They twist off, and the new one is just twisted on. However, a problem arises for replacing decorative radiator cap covers. Decorative radiator cap covers are typically bonded or glued to the actual radiator cap, and removing them is often hard, if not possible. This often results in significant extra expense, as the decorative radiator cap covers then need to be replaced along with the radiator caps with which they are integrated.

This is especially a problem since decorative radiator cap covers often cost significantly more than the radiator caps that they are utilized with.

It would be advantageous to provide an easy and cost effective replacement system for decorative radiator cap covers.

BRIEF SUMMARY OF THE INVENTION

A decorative radiator cap cover retention system provides for removable attachment of a radiator cap cover to a radiator cap using a retaining ring inside the radiator cap cover to removably attach the cap cover to the radiator cap. The inside of the radiator cap cover may have indentions conforming to the shape of the radiator cap and a groove for the retaining ring. Preferably, the number and shape of the intentions is sufficient to match the shape of many radiator caps.

BRIEF DESCRIPTION OF THE DRAWINGS

FIG. 1 is a diagram showing a perspective view of a novel decorative radiator cap cover system, in accordance with one embodiment of the prior art;

FIG. 2 is a diagram showing a side plan view of the decorative radiator cap cover system shown in FIG. 1;

FIG. 3 is a perspective view of a decorative radiator cap cover, in accordance with the embodiment shown in FIGS. 1 and 2;

FIG. 4 is a top plan view of the decorative radiator cap cover shown in FIG. 3;

FIG. 5 is a side plan view of the decorative radiator cap cover shown in FIG. 3;

FIG. 6 is a bottom plan view of the decorative radiator cap cover shown in FIG. 3; and FIG. 7 is a sectional view of the decorative radiator cap cover shown in FIG. 6.

DETAILED DESCRIPTION

A decorative radiator cap cover system allows for easy attachment to and removal of a radiator cap with a decorative radiator cap cover. Instead of having to purchase a new radiator cap cover every time the radiator cap has to be replaced, this invention allows the radiator cap cover to be mated to, easily attached to, and removed from more than one radiator caps over time, saving time and money.

FIG. 1 is a diagram showing a perspective view of a novel decorative radiator cap cover system, in accordance with one embodiment of the prior art. A radiator cap cover 12 fits over a radiator cap 14. The radiator cap cover 12 is then affixed to the radiator cap 14 with a retaining ring 16 to form an assembled radiator cap and cover. The assembled radiator cap and cover can then be installed on the fill neck 18 of a radiator in the customary manner. The assembled radiator cap and cover can be removed and reinstalled onto the fill neck 18 of the radiator as often as is necessary. Then, when the radiator cap 14 wears out, the retaining ring 16 can be removed, another radiator cap 14 purchased, and the system can then be reassembled by attaching the radiator cap cover 12 to the new radiator cap 14 with the retaining ring 16.

The radiator cap 14 is shown with four nubs 15, knobs, or extrusions. This is exemplary, and radiator caps 14 may have more or fewer of them. Probably more typical are radiator caps with two nubs 15 on opposite side of the cap. As another alternative, some radiator caps 14 have a polygonal shape, such as hexagonal. All of these configurations are within the scope of the present invention. The primary purpose of these nubs 15, knobs, extrusions, or polygonal shapes is to provide easier installation and removal of a radiator cap 14 on a fill neck 18 by making it easier for people to grab the radiator caps.

FIG. 2 is a diagram showing a side plan view of the decorative radiator cap cover system shown in FIG. 1. The radiator cap cover 12, radiator cap 14, retaining ring 16, and radiator fill neck 18 are again shown, this time from the side.

FIG. 3 is a perspective view of a decorative radiator cap cover 12, in accordance with the embodiment shown in FIGS. 1 and 2. The radiator cap cover 12 is shaped like a lid or cap, with a hollow interior. However, on the inside outer rim of the radiator cap cover 12 are scallops or indentions 22 that match and fit the nubs 15 or geometric shape of the radiator caps 14 over which the radiator cap cover 12 may be installed. In the embodiment shown, twenty four (24) scallops or indentions 22 are shown, which allows the radiator cap cover 12 to work with most radiator caps 14, whether they have different configurations of nubs 15, or are of a polygonal shape. By mating the radiator cap 14 nubs 15 or polygonal shape to the scallops 22 on the inside of the radiator cap cover 12, the radiator cap cover 12 can be utilized to install and/or remove the entire assembled radiator cap cover system, since rotating the radiator cap cover 12 results in an identical rotation of the radiator cap 14 to which it is removably attached. Other numbers of nubs 15 and shapes are also within the scope of the present invention.

Also, towards the bottom of the inside rim of the radiator cap cover 12 are located groves 26 for the retaining ring 16. The retaining ring 16 may be a snap ring, a wire ring, or other similar retention means. The retaining ring 16 is inserted in these groves 26 during installation, removably attaching the radiator cap cover 12 to the radiator cap 14. The retaining ring 16 can then be later removed from the radiator cap cover 12, allowing for disassembly of the radiator cap cover assembly. Other retention means for mechanically removably coupling the radiator cap cover 12 to the radiator cap 14 are also within the scope of the present invention, including, but not limited to: set screws, roll pins, springs, or crimping the two parts together.

FIG. 4 is a top plan view, FIG. 5 is a side plan view, and FIG. 6 is a bottom plan view of the decorative radiator cap cover 12 shown in FIG. 3. The shape of the radiator cap cover 12 is exemplary, and other shapes are also within the scope of the present invention. Also note that FIG. 6 shows twenty-four scallops or indentions 22 designed to mate with nubs 15 on radiator caps 14. This is also exemplary, and other configurations are also within the scope of the present invention.

FIG. 7 is a sectional view of the decorative radiator cap cover shown in FIG. 6 taken along the section line marked 7-7. The shape of the scallops or indentions 22 on the inside of the radiator cap cover 12 can be better seen here, as well as the location of the groove or notches 26 for the retaining ring 16. Note that the grooves or notches 26 should be located to give enough room to allow the installation of the radiator cap 14 within the inside of the radiator cap cover 12.

Those skilled in the art will recognize that modifications and variations can be made without departing from the spirit of the invention. Therefore, it is intended that this invention encompass all such variations and modifications as fall within the scope of the appended claims.

What is claimed is:

1. A decorative radiator cap cover retention system comprising:

a decorative radiator cap cover having a hollow interior receiving a radiator cap and formed by an interior upper surface and an interior side surface, wherein the radiator cap having an outer surface along the circumference of the radiator cap; and a removable retaining ring affixed to the outer surface of the radiator cap and engaging the interior side surface of the decorative radiator cap cover, wherein the interior side surface of the decorative radiator cap cover comprises scallops configured to mate with a shape of the outer surface of the radiator cap.

2. The decorative radiator cap cover retention system in claim 1 wherein the retaining ring is a semicircular shape.

3. The decorative radiator cap cover retention system in claim 1 wherein:

the interior side surface of the decorative radiator cap cover comprises twenty-four scallops.

4. The decorative radiator cap cover retention system in claim 1 wherein:

the interior side surface of the decorative radiator cap cover further comprises groves configured to seat the retaining ring.

* * * * *